US006549558B1

(12) United States Patent
Okada et al.

(10) Patent No.: US 6,549,558 B1
(45) Date of Patent: Apr. 15, 2003

(54) MELTING AND HOLDING FURNACE FOR ALUMINUM BLOCKS

(75) Inventors: Tamio Okada, Warabi (JP); Hideo Yoshikawa, Yokohama (JP); Michio Matsuura, Yokohama (JP); Toshiaki Sano, Tokyo (JP); Tomohiro Hatanaka, Tokyo (JP)

(73) Assignee: Nippon Crucible Co., Ltd., Tokyo (JP)

( * ) Notice: Subject to any disclaimer, the term of this patent is extended or adjusted under 35 U.S.C. 154(b) by 0 days.

(21) Appl. No.: 09/830,110

(22) PCT Filed: Oct. 21, 1999

(86) PCT No.: PCT/JP99/05824

§ 371 (c)(1),
(2), (4) Date: Apr. 20, 2001

(87) PCT Pub. No.: WO00/25078

PCT Pub. Date: May 4, 2000

(30) Foreign Application Priority Data

Oct. 23, 1998 (JP) ..... 10-301963

(51) Int. Cl.[7] ..... F27D 23/00
(52) U.S. Cl. ..... 373/78; 373/77; 373/80
(58) Field of Search ..... 373/15, 21, 29–31, 373/33, 34, 43, 42, 67, 71–73, 77, 78–81, 109, 110, 115, 118, 137, 122; 75/687; 266/144; 264/332; 117/900

(56) References Cited

U.S. PATENT DOCUMENTS

| | | | |
|---|---|---|---|
| 152,906 | A | 7/1874 | Luce |
| 771,675 | A | 10/1904 | Smith |
| 1,707,161 | A | 3/1929 | Hoy |
| 1,931,144 | A | 10/1933 | Gilbert |
| 2,472,465 | A | 6/1949 | Cornell |
| 5,810,907 | A | 9/1998 | Okada et al. |

FOREIGN PATENT DOCUMENTS

| | | |
|---|---|---|
| JP | 03059389 | 3/1991 |

OTHER PUBLICATIONS

Duries Francois: Improving gas furnaces for the melting of non–ferrous metal alloys, Foundry Trade Journal vol. 161, Apr. 9, 1987, pp. 282, 284 and 290.

Godfrey N.V., Improving Performances of Gas–Fired Crucible Furnaces for Melting Aluminun, Industrial Heating, vol. 56, No. 10, Oct. 1989, pp. 32–34.

*Primary Examiner*—Tu Ba Hoang
(74) *Attorney, Agent, or Firm*—Knobbe, Martens, Olson & Bear LLP

(57) ABSTRACT

A furnace for melting and holding aluminum materials, the furnace being characterized in that the furnace comprises: a pre-heating tower for pre-heating aluminum blocks, a melting crucible furnace which receives a supply of aluminum blocks from the pre-heating tower at a position immediately under the pre-heating tower, and a holding crucible furnace which receives a continuous supply of molten aluminum from the melting crucible furnace at a position side-by-side with the melting crucible furnace, and that an exhaust gas resulting from combustion in the melting crucible furnace can be supplied to the inside of the pre-heating tower as an ascending current for heat exchange with aluminum blocks, the furnace being capable of continuous melting and energy savings.

8 Claims, 1 Drawing Sheet

MELTING AND HOLDING FURNACE FOR ALUMINUM BLOCKS

TECHNICAL FIELD OF THE INVENTION

The present invention relates to a melting and holding furnace for aluminum blocks, and more particularly to a melting and holding furnace comprising, as constituent elements, a pre-heating tower for pre-heating aluminum blocks and two crucible furnaces for melting and holding aluminum materials respectively. The term "aluminum block" used in the specification refers to aluminum ingots or like aluminum masses, collected aluminum-containing materials (empty cans of aluminum and other aluminum scraps) pressed into blocks in substantially the similar shape to aluminum ingots, and so on.

BACKGROUND ART

To melt and hold aluminum materials, various apparatus are known and include an apparatus wherein molten aluminum is transported and distributed by a ladle or the like from a centralized melting furnace to an electrically or otherwise heated individual furnace solely serving for holding purpose; an individual furnace provided for melting and holding purposes and housing a melting chamber and a holding chamber each having a receptacle constructed with refractory bricks and accommodating molten metal; a graphite crucible furnace; etc.

The graphite crucible furnace has a construction wherein a graphite crucible is provided in a cylindrically constructed furnace and the crucible is heated by a burner. For melting in the graphite crucible, metal ingots are charged directly from an upper portion of the crucible. If metal ingots are thrown into the crucible and positioned diagonally to contact the crucible sidewall, the ingots would be likely to push apart the sidewall due to thermal expansion. In view of this likelihood, metal ingots as longitudinally arranged are thrown into the crucible.

In melting aluminum materials in a conventional crucible furnace, aluminum ingots have been directly thrown into a crucible through an opening formed therein. Consequently, the melt of aluminum is cooled immediately thereafter, and the temperature of aluminum melt begins to arise after the aluminum ingots have been all melted. In this case, on reaching a specific temperature, the melt is drawn out for casting. When the amount of the melt decreases by bailing out the melt, aluminum ingots are supplied again. In this way, melting and bailing-out operations are alternately practiced and repeated batchwise in the crucible furnace. Consequently problems arise that a constant supply of the melt is not done, and that a small amount of aluminum ingots should be supplied to adjust the temperature of the melt. Further, aluminum materials such as aluminum ingots are supplied to the melt without being preheated so that the temperature of the melt is widely variable.

When a centralized melting furnace is used, a large amount of molten aluminum should be retained all the time. Moreover, the centralized melting furnace is difficult to use in melting aluminum blocks currently produced including a wide variety of materials. In addition, the temperature of the melt being distributed should be elevated to make up for the reduction in the temperature unavoidably caused by the distribution of the melt. In other words, such furnace is not suitable for diversified small-quantity production. Another problem is a difficulty entailed in control of production since a specific amount of the melt cannot be retained during the maintenance of the centralized melting furnace.

Moreover, in the case of using an integrated type melting and holding furnace having a melt receptacle lined with bricks or the like, the flame of the heating burner is directly applied to the melt. Said furnace raises problems such as contaminating the melt with an oxide or absorbing hydrogen gas, thereby affecting the quality of cast articles. The furnace is also defective in leading to a large amount of accumulated heat in the furnace wall, making it difficult to achieve energy savings and necessitating high maintenance costs and a period of time for the relining of the furnace wall with bricks at a regular time.

DISCLOSURE OF THE INVENTION

A main object of the present invention is to provide a melting and holding furnace for aluminum blocks which furnace is capable of overcoming all of the foregoing prior art problems, continuously melting aluminum materials and attaining energy savings.

To achieve the foregoing object, the present invention provides a melting and holding furnace for aluminum blocks, the furnace being characterized in that the furnace comprises:

- a pre-heating tower for pre-heating aluminum blocks,
- a melting crucible furnace which receives a supply of aluminum blocks from the pre-heating tower at a position immediately under the pre-heating tower, and
- a holding crucible furnace which receives a continuous supply of molten aluminum from the melting crucible furnace at a position side-by-side with the melting crucible furnace, and
- that exhaust gas resulting from combustion in the melting crucible furnace can be supplied to the inside of the pre-heating tower as an ascending current for heat exchange with aluminum blocks.

The melting and holding furnace of the present invention can achieve the following results.

(1) The furnace of the present invention can be used in melting not only aluminum blocks but a composite material comprising aluminum (or aluminum alloy) and other metals such as iron.

(2) The furnace of the present invention is a crucible-type melting and holding furnace capable of continuously melting metal.

(3) The furnace of the present invention can melt a metal at a specific low temperature in the vicinity of the melting point of aluminum, thereby giving numerous beneficial results that a less quantity of oxide, such as aluminum oxide, is generated and hydrogen gas is absorbed in a less amount, resulting in a high quality melt; the temperature in the holding crucible furnace can be easily controlled; and the service life of the crucible can be extended because of good conditions for the durability of the crucible.

(4) The pre-heating tower enables a great degree of energy savings, and the furnace of the invention shows a high melting capability relative to its furnace volume and is lightweight and compact.

(5) Since the crucible can be easily replaced, the furnace is suitable for melting diversified meterials.

(6) The stoppage of melting and the control of a melting rate can be adjusted only with the combustion gas, thereby facilitating the control of production.

(7) The furnace need not be repaired on a large scale with regular intervals, and maintenance can be easily performed at low costs only by replacement of crucibles.

(8) Working environment can be improved because of low-temperature exhaust gas.

Other features of the present invention become apparent from the following description with reference to the accompanying drawing.

BEST MODE FOR CARRYING OUT THE INVENTION

Figure 1:
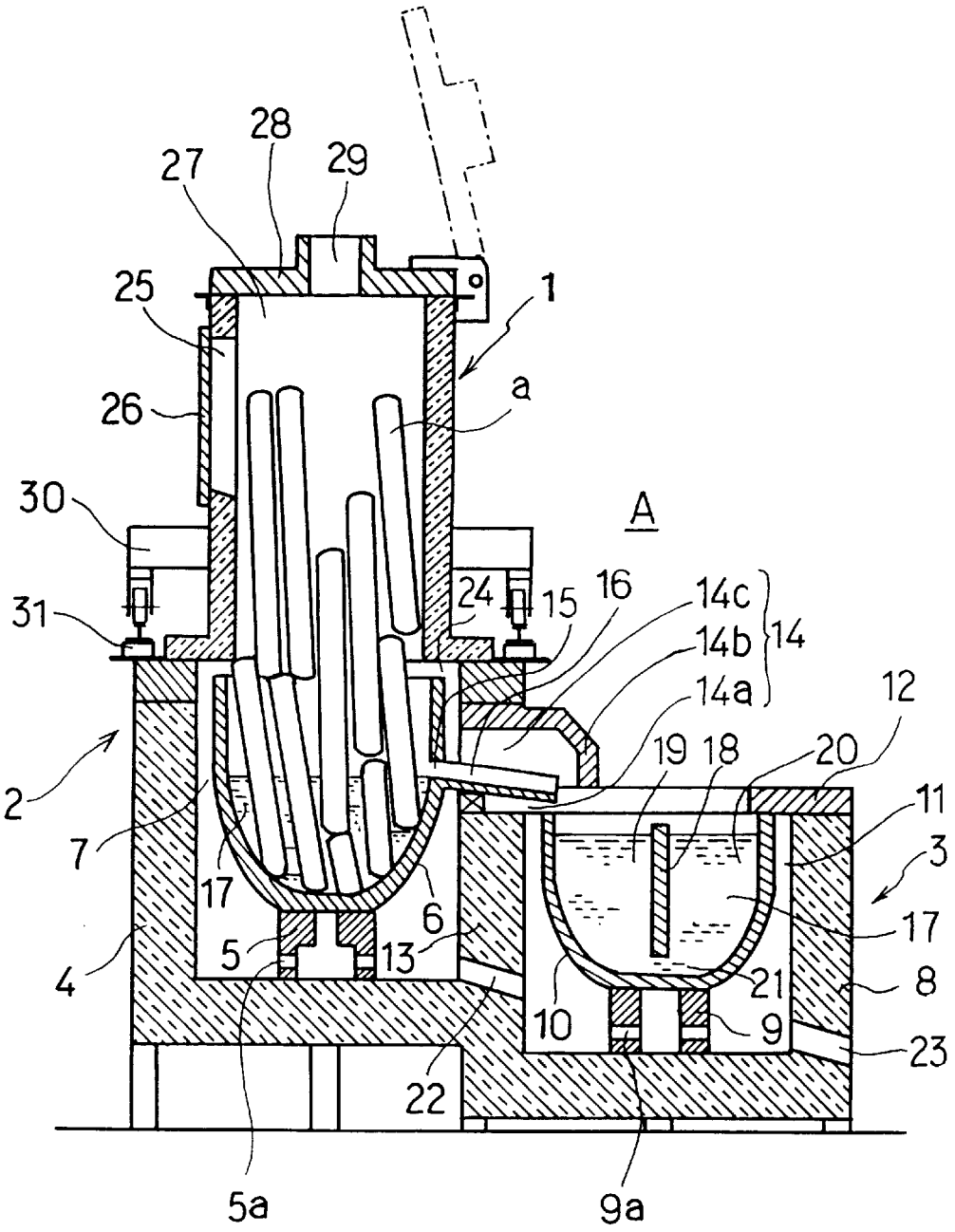
FIG. 1 is a longitudinal cross section view schematically showing one embodiment of the present invention.

An embodiment of the present invention will be described with reference to the accompanying drawing. FIG. 1 schematically shows a melting and holding furnace A in its entirety according to one embodiment of the invention. The melting and holding furnace A comprises, as main constituent elements, a pre-heating tower 1 for aluminum blocks a, a melting crucible furnace 2 arranged immediately under the pre-heating tower 1 and a holding crucible furnace 3 disposed side-by-side with the melting crucible furnace 2.

The melting crucible furnace 2 has a first furnace body 4 and a melting crucible 6 placed on a first crucible stand 5 in the first furnace body 4. A first surrounding space 7 is formed around the crucible 6 and between the crucible 6 and the first furnace body 4. The first surrounding space 7 serves as a passage through which a combustion gas ascends after being supplied from a combustion gas supply (not shown) disposed at a lower portion of the sidewall of the first furnace body 4.

The holding crucible furnace 3 has a second furnace body 8 and a holding crucible 10 placed on a second crucible stand 9 in the second furnace body 8. A second surrounding space 11 is formed around the holding crucible 10. The second surrounding space 11 serves as a passage through which a combustion gas ascends after being supplied from a combustion gas supply (not shown) disposed at a lower portion of the sidewall of the second furnace body 8. The upper end of the space 11 is closed with a weight lid 12 of the holding crucible 10 and is thereby shut off from the outside air. Suitably the melting crucible 6 and the holding crucible 10 are made of graphite.

Preferably the crucible stands 5, 9 are cylindrical and have, on their side, air flow holes 5*a*, 9*a* for the combustion gas to heat the bottoms of crucibles 6, 10.

The furnace bodies 4, 8 are lined with a heat-insulating material such as a ceramic heat-insulating material, and a common sidewall 13 is provided at the boundary between the bodies 4, 8. The common sidewall 13 has a communicating passage 14 for communication between the first and second spaces 7, 11.

The communicating passage 14 comprises an outlet opening 14*a* formed in the weight lid 12 on the side of the common sidewall 13 to communicate with the upper end of the second surrounding space 11, an exhaust gas hood 14*b* so formed in the common sidewall 13 as to cover a space over the outlet opening 14*a*, and an inlet opening 14*c* so formed in the common sidewall 13 as to open in the hood 14*b*. The exhaust gas flows upward through the outlet opening 14*a*. The exhaust gas in the second surrounding space 11 is collected by the hood 14*b* to flow through the inlet opening 14*c* into the first surrounding space 7.

The melting crucible 6 is communicated with the holding crucible 10, for example, via a trough-like conduit 16 extending from a discharge port 15 of the overflow type formed in a trunk portion of the crucible 6 toward the holding crucible furnace 3. A melt 17 is continuously transported from the inside of the crucible 6 via the discharge port 15 in an overflow current through the conduit 16 into the crucible 10. The continuous flow of the melt 17 is formed by a difference in the level of melt surface in the crucibles 6, 10. The position of the discharge port 15 in the trunk portion of the crucible 6 is selected and determined taking into consideration the amount of the melt 17 retained in the crucible 6 or the level of melt surface.

The conduit 16 extends through the inlet opening 14*c* of the communicating passage 14 to a position above the melt surface in the holding crucible 10. A space above the conduit 16 is covered with the exhaust gas hood 14*b*. The conduit 16 is exposed to the exhaust gas flowing in the communicating passage 14 and is thereby heated to prevent the reduction of melt temperature during the transport of the melt.

The holding crucible 10 is internally divided with a partition member 18 into a temperature controlling chamber 19 and a bailing-out chamber 20. The two chambers 19, 20 are in communication with each other via a connection space 21 below the partition member 18. The temperature controlling chamber 19 is permitted to receive the melt 17 flowing from the melting crucible 6.

The melt 17 is heated to a specified temperature by the combustion gas in the temperature controlling chamber 19 wherein the melt is variously treated and is put under sedimentation of impurities such as oxides.

The melt may leak through cracks or the like in the crucibles 6, 10. To discharge the leaked melt to outside the furnace, for example, drain vents 22, 23 are formed in a lower end of the common sidewall 13 and a lower end of the sidewall of the second furnace body 8, respectively.

The furnace body 4 of the melting crucible furnace 2 is in the shape of a cylinder with an open top and a closed bottom. The pre-heating tower 1 in the cylindrical shape is concentrically laid in 2-tier arrangement on the upper end of the furnace body 4. The lower end of the pre-heating tower 1 is opened downward toward the upper end of the crucible 6 into the crucible 6 so that aluminum blocks a can be thrown into the crucible 6 through the pre-heating tower 1.

The upper end of the first surrounding space 7 in the first furnace body 4 is communicated with the inside of the pre-heating tower 1 via an annular space 24 between the upper end of the crucible 6 and the lower end of the pre-heating tower 1 so that the exhaust gas can be supplied as a pre-heating source into the pre-heating tower 1.

The pre-heating tower 1 has openings 25, 27 for charge of aluminum blocks in a trunk portion of the pre-heating tower 1 and at the upper end thereof. The openings 25, 27 are closed with lids 26, 28, respectively. The lid 28 covering the upper end of the pre-heating tower 1 has a degassing hole 29 for discharge of the exhaust gas. The degassing hole 29 is formed to lead the exhaust gas as an aspiring current, due to draft effect, from the surrounding space 7 via the;annular space 24 into the pre-heating tower 1. The openings 25, 27 can be opened or closed with an automatically opening and closing mechanism (not shown) provided with a driving device.

The pre-heating tower 1 can be moved from its position in a 2-tier arrangement shown in FIG.1 to replace the melting crucible 6 and to draw out the remaining melt from the crucible 6. The overall weight of the pre-heating tower 1 is supported by a carrier 30 which can travel on guide rails 31 fixedly mounted on the first furnace body 4. When the carrier 30 is moved on the guide rails 31, the pre-heating tower 1 can slide for displacement from the first position in a 2-tier arrangement with the first furnace body 4 to a second position (not shown) wherein the pre-heating tower 1 is disengaged from the 2-tier arrangement and the upper end of the body 4 is completely opened. The carrier 30 can be stopped at the first or second position using various position-controlling means.

FIG. 1 shows the melting and holding furnace of the present invention as routinely operated. The combustion gas is supplied from the bottom of the first furnace body 4 into the body 4 to heat the melting crucible 6 while ascending in the first surrounding space 7 to become an exhaust gas. The resulting exhaust gas flows upward from the upper end of the first surrounding space 7 via the annular space 24 communicating with the space 7 into the pre-heating tower 1 wherein the exhaust gas carries out heat exchange with the aluminum blocks a for effective use as a pre-heating source. Then the exhaust gas is made to flow through the degassing hole 29 in the lid 28 for discharge outside the furnace. The exhaust gas is discharged outside the furnace at a temperature lowered, e.g. to 375° C. or lower because of heat exchange with the aluminum blocks a. The reduction in the temperature of the exhaust gas serves to improve the working environment.

On the other hand, the combustion gas is supplied from the bottom of the second furnace body 8 into the body 8 to heat the holding crucible 10 while ascending in the second surrounding space 11 to become an exhaust gas. The resulting exhaust gas flows upward from the upper end of the second surrounding space 11 via the passage 14 communicating therewith into the first surrounding space 7 to join the exhaust gas in the space 7 for effective use as a source for pre-heating the aluminum blocks a in the pre-heating tower 1. The exhaust gas can heat the conduit 16 and the melt being transferred during the transport in the communicating passage 14, and can be also effectively used as a heating source for preventing the reduction of the melt temperature.

The aluminum blocks a can sequentially melt, starting from the blocks lying in the lower position immersed in the melt 17 among those within the melting crucible 6. The aluminum blocks a are pre-heated by heat exchange with the exhaust gas, whereby the temperature of the melt is varied in a lesser degree than when cool ingots are directly immersed into the melt 17. Aluminum blocks a descend into the melt 17 due to its own weight with the progress of melting, and partly exist as a solid all the time. The heat of the combustion gas is partly consumed to melt the solid aluminum (64.8 cal/kg) so that the melt 17 is held at a substantially constant temperature (e.g. about 650° C.) in the vicinity of the melting point of aluminum.

The melt 17 in the melting crucible 6 is continuously transported in an amount corresponding to the melting amount of aluminum blocks a via the discharge port 15 in an overflow current due to a difference in the level of liquid surfaces through the conduit 16 into the temperature controlling chamber 19 of the holding crucible 10 to achieve continuous distribution of the melt 17. For continuous distribution due to overflow, the melting crucible 6 is filled with a constant amount of melt 17 all the time.

The melt 17 flowing into the temperature controlling chamber 19 of the holding crucible 10 is heated by the combustion gas from a temperature in the vicinity of the melting point of aluminum to the temperature for use. The melt 17 is variously treated and is put under sedimentation of contamination with an oxide in the temperature controlling chamber 19. The melt 17 in the temperature controlling chamber 19 flows via the connection space 21 below the lower end of the partition member 18 into the bailing-out chamber 20 to make ready for bailing out.

It is the most important in the present invention that the pre-heating tower 1 is attached to the conventional crucible furnace, whereby aluminum blocks a are heated to a high temperature in the pre-heating tower 1 due to heat exchange with the high-temperature exhaust gas generated in the crucible furnace, enabling a high degree of energy savings. The heat of the exhaust gas has been heretofore utilized in said various melting furnaces, but not in crucible furnaces for several reasons. Presumably one of the reasons why a heat exchanger was not disposed in a crucible furnace is the structural and operational aspects of a crucible furnace that the melt is bailed out batchwise through a tapping orifice of the crucible. In conventional crucible furnaces, the high-temperature exhaust gas for heating the crucible was discharged through a space between the furnace wall and the open end portion of the crucible into the atmosphere. When aluminum is melted with the top opening closed with a lid, the high-temperature exhaust gas is discharged through a degassing duct formed in the furnace wall and then through a chimney without effective use of high-temperature exhaust gas.

The melting and holding furnace for aluminum blocks according to the present invention comprises a pre-heating tower 1 and two crucible furnaces 2, 3 for carrying out separately a melting operation and a holding operation and is adapted to continuously distribute the melt from the melting crucible furnace 2 to the holding crucible furnace 3 and is capable of bailing out the melt from the side of the holding crucible furnace. In the furnace having the foregoing construction, the pre-heating tower 1 can be disposed over the opening at the upper end of the melting crucible furnace 2, thereby enabling the exhaust gas in the melting crucible furnace 2 to pre-heat aluminum blocks in the pre-heating tower 1. The exhaust gas emitted in the holding crucible furnace 3 is made to flow into the melting crucible furnace. In the furnace having the foregoing construction, substantially the total amount of the exhaust gases generated in the crucible furnaces 2, 3 can be effectively used for pre-heating purpose in the pre-heating tower 1.

In accordance with the present invention, aluminum blocks a are immersed all the time in the melt 17 in the melting crucible 6 and the heat of the combustion gas is partly consumed to melt the immersed aluminum solid so that the temperature of the melt 17 is scarcely altered even when heated by the combustion gas, while only the melting speed is altered. Consequently, to stop the distribution of melt to the holding furnace, the application of heat is ceased, whereby the influx is immediately stopped. Therefore, the production amount can be easily controlled.

The aluminum-containing materials collected for recovery include those to be disposed of without recycling because of the iron component incorporated in the collected materials. Such collected aluminum/iron composite materials, when melted in the furnace of the invention, facilitate separation of iron component because the iron component is difficult to melt in molten aluminum due to the low-temperature melting as described above, for example, the iron component is separated out in the bottom of the melting crucible 6 instead of being melted.

A constant amount of the melt 17 is filled in the melting crucible 6 all the time and the melt 17 has a low temperature (about 650° C.). These factors provide good conditions for the durability of crucibles, leading to extended service life of the melting crucible 6. Especially the conditions are suitable when graphite with a high heat conductivity is used for the crucible 6.

Further, the walls of crucible furnaces 2, 3 are kept out of contact with the melt 17 and thus can be lined with a heat-insulating material of ceramic fiber type. Since the heat-insulating material of ceramic fiber type is lightweight and thus accumulates a small amount of heat, the furnace wall radiates only a small amount of heat, leading to energy savings.

What is claimed:

1. A melting and holding furnace for aluminum blocks, the furnace being characterized in that the furnace comprises:

a pre-heating tower for pre-heating aluminum blocks, a melting crucible furnace comprising a melting crucible enclosed by a first furnace body, which melting crucible receives a supply of aluminum blocks from the pre-heating tower at a position immediately under the pre-heating tower, wherein a surrounding space is formed around the melting crucible and between the melting crucible and the first furnace body and a combustion gas is provided to the space and exhaust gas utilized in the melting crucible furnace is supplied to the pre-heating tower as an ascending current for heat exchange with the aluminum blocks, and a holding crucible furnace disposed side-by-side with said melting crucible furnace which receives a continuous supply of molten aluminum from the melting crucible of the melting crucible furnace, wherein said melting crucible and said holding crucible furnace are communicated with each other via a conduit extending from a trunk portion of the melting crucible toward said holding crucible furnace so that molten aluminum overflows from said melting crucible into said holding crucible furnace through the conduit.

2. The melting and holding furnace according to claim 1, wherein the pre-heating tower has an opening for charge of aluminum blocks in at least one of a trunk portion of the pre-heating tower or the upper end thereof and wherein the opening is closed with a lid which has a degassing hole for discharge of the exhaust gas.

3. The melting and holding furnace according to claim 1 or 2, wherein the melting crucible furnace and the holding crucible furnace are lined with a ceramic fiber-type heat-insulating material.

4. The melting and holding furnace according to claim 1, wherein the exhaust gas in the holding crucible furnace is made to flow to join the exhaust gas in the melting crucible furnace for supply to the pre-heating tower as a pre-heating source.

5. The melting and holding furnace according to claim 1, wherein the melting crucible furnace has a melting crucible of graphite supported by a crucible stand and the holding crucible furnace has a holding crucible of graphite supported by a crucible stand.

6. The melting and holding furnace according to claim 5, wherein at least one of said crucible stands is cylindrical and a combustion gas is adapted to flow through the crucible stand.

7. The melting and holding furnace according to claim 1, wherein the pre-heating tower can selectively take a first position in a 2-tier arrangement or a second position separated transversely from the first position by sliding the tower, wherein at the second position the opening at the upper end of the melting crucible furnace is available as a working opening for bailing out the remaining melt and for replacement of the melting crucible.

8. The melting and holding furnace according to claim 1, wherein the aluminum blocks are selected from the group consisting of aluminum ingots and collected aluminum-containing materials pressed into blocks.

* * * * *